US007290855B2

(12) United States Patent
Chikuma et al.

(10) Patent No.: US 7,290,855 B2
(45) Date of Patent: Nov. 6, 2007

(54) PRINTING APPARATUS AND PRINTING METHOD

(75) Inventors: Toshiyuki Chikuma, Kawasaki (JP); Hidehiko Kanda, Yokohama (JP); Norihiro Kawatoko, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 11/202,097

(22) Filed: Aug. 12, 2005

(65) Prior Publication Data

US 2006/0038846 A1 Feb. 23, 2006

(30) Foreign Application Priority Data

Aug. 18, 2004 (JP) ..... 2004-238864

(51) Int. Cl.
*B41J 2/15* (2006.01)

(52) U.S. Cl. ..... 347/41; 347/40

(58) Field of Classification Search ..... 347/12, 347/13, 16, 40, 41, 5, 9, 101
See application file for complete search history.

(56) References Cited

U.S. PATENT DOCUMENTS 6,033,055 A * 3/2000 Nagoshi et al. ..... 347/43
6,302,517 B1 * 10/2001 Kanaya ..... 347/41
6,334,659 B1 1/2002 Maeda et al.
6,364,446 B1 4/2002 Ishikawa et al.
6,485,125 B2 * 11/2002 Fujioka et al. ..... 347/41
6,712,443 B2 * 3/2004 Kanda et al. ..... 347/16
2002/0109752 A1 * 8/2002 Sato ..... 347/43
2003/0103101 A1 * 6/2003 Otsuki ..... 347/41
2003/0103102 A1 * 6/2003 Otsuki ..... 347/41
2003/0128252 A1 * 7/2003 Vanhooydonck et al. ..... 347/41
2003/0184609 A1 * 10/2003 Bates et al. ..... 347/16

FOREIGN PATENT DOCUMENTS

JP 10-157137 6/1998
JP 11-291506 10/1999

* cited by examiner

*Primary Examiner*—Matthew Luu
*Assistant Examiner*—Joshua M Dubnow
(74) *Attorney, Agent, or Firm*—Fitzpatrick, Cella, Harper & Scinto

(57) ABSTRACT

When conveying tables for conveying the printing medium are selected to perform interlace printing, the occurrence of unevenness in an image which results from switching of the tables is prevented. It is determined whether a phase of the conveying table is a transfer inhibition phase in transfer to a printing area. In the case of the transfer inhibition phase, the switching is not made to a new table, but the previously used table is used. Thus, the switching can be made to a conveying table so as not to make a shift amount +1/2N or −1/N continue. Consequently, it is possible to prevent the occurrence of unevenness in an image which is caused by 1/N deviation of a printing position in a sub-scanning direction with regard to print data at the time of transfer from a rear end area to the normal area or the normal area to the rear end area.

9 Claims, 15 Drawing Sheets

| PHASE | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|
| FRONT END | 10 | 0 | 9 | 0 | 0 | 0 | 11 | 0 | 10 | 0 | 9 | 0 | 0 | 0 | 11 | 0 | 60 |
| NORMAL | 10 | 0 | 9 | 10 | 10 | 0 | 11 | 10 | 10 | 0 | 9 | 10 | 10 | 0 | 11 | 10 | 120 |
| REAR END | 10 | 0 | 9 | 0 | 0 | 0 | 11 | 0 | 10 | 0 | 9 | 0 | 0 | 0 | 11 | 0 | 60 |

FIG.4A

PRIOR ART

| PHASE | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|
| FRONT END | 10 | 0 | 9 | 0 | 0 | 0 | 11 | 0 | 10 | 0 | 9 | 0 | 0 | 0 | 11 | 0 | 60 |
| NORMAL | 10 | 0 | 9 | 10 | 10 | 0 | 11 | 10 | 10 | 0 | 9 | 10 | 10 | 0 | 11 | 10 | 120 |
| REAR END | 10 | 0 | 9 | 0 | 0 | 0 | 11 | 0 | 10 | 0 | 9 | 0 | 0 | 0 | 11 | 0 | 60 |

FIG.4B

PRIOR ART

| PHASE | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|
| FRONT END | 10.5 | 0 | 9.5 | 0 | 10.5 | 0 | 0 | 0 | 9.5 | 0 | 0 | 0 | 10.5 | 0 | 9.5 | 0 | 60 |
| NORMAL | 10.5 | 0 | 9.5 | 10 | 10.5 | 0 | 9.5 | 10 | 10.5 | 0 | 9.5 | 10 | 10.5 | 0 | 9.5 | 10 | 120 |
| REAR END | 10.5 | 0 | 9.5 | 0 | 10.5 | 0 | 0 | 0 | 9.5 | 0 | 0 | 0 | 10.5 | 0 | 9.5 | 0 | 60 |

FIG.7A

| PHASE | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|
| FRONT END | 10.5 | 0 | 9.5 | 0 | 10.5 | 0 | 0 | 0 | 9.5 | 0 | 0 | 0 | 10.5 | 0 | 9.5 | 0 | 60 |
| NORMAL | 10.5 | 0 | 9.5 | 10 | 10.5 | 0 | 9.5 | 10 | 10.5 | 0 | 9.5 | 10 | 10.5 | 0 | 9.5 | 10 | 120 |
| REAR END | 10.5 | 0 | 9.5 | 0 | 10.5 | 0 | 0 | 0 | 9.5 | 0 | 0 | 0 | 10.5 | 0 | 9.5 | 0 | 60 |

FIG.7B

| PHASE | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|
| FRONT END | 10.5 | 0 | 9.5 | 0 | 10.5 | 0 | 0 | 0 | 9.5 | 0 | 0 | 0 | 10.5 | 0 | 9.5 | 0 | 60 |
| NORMAL | 10.5 | 0 | 9.5 | 10 | 10.5 | 0 | 9.5 | 10 | 10.5 | 0 | 9.5 | 10 | 10.5 | 0 | 9.5 | 10 | 120 |
| REAR END | 10.5 | 0 | 9.5 | 0 | 10.5 | 0 | 0 | 0 | 9.5 | 0 | 0 | 0 | 10.5 | 0 | 9.5 | 0 | 60 |

FIG.7C

| PHASE | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|
| REAR END | 10.5 | 0 | 9.5 | 0 | 10.5 | 0 | 0 | 0 | 9.5 | 0 | 0 | 0 | 10.5 | 0 | 9.5 | 0 | 60 |
| RETURN | 0 | 0 | 0 | 0 | 10.5 | 0 | 0 | 0 | 9.5 | 0 | 0 | 0 | 10.5 | 0 | 9.5 | 0 | 60 |

FIG.13

| PHASE | | 0 | 1 | 2 | 3 | 4 | 5 | 6 | 7 | 8 | 9 | 10 | 11 | 12 | 13 | 14 | 15 | THE NUMBER OF PRINTING ELEMENTS TO BE USED |
|---|---|---|---|---|---|---|---|---|---|---|---|---|---|---|---|---|---|---|
| FRONT END | CONVEYANCE TABLE | 10.5 | 0 | 9.5 | 0 | 10.5 | 0 | 0 | 0 | 9.5 | 0 | 0 | 0 | 10.5 | 0 | 9.5 | 0 | 60 |
| | TRANSFER DESTINATION PHASE | 1 | 2 | 3 | 4 | 5 | 6 | 6 | 6 | 7 | 7 | 11 | 12 | 13 | 14 | 15 | 0 | |
| NORMAL | CONVEYANCE TABLE | 10.5 | 0 | 9.5 | 10 | 10.5 | 0 | 9.5 | 10 | 10.5 | 0 | 9.5 | 10 | 10.5 | 0 | 9.5 | 10 | 120 |
| | TRANSFER DESTINATION PHASE | 1 | 2 | 3 | 4 | 5 | 6 | 11 | 11 | 13 | 13 | 11 | 12 | 13 | 14 | 15 | 0 | |
| REAR END | CONVEYANCE TABLE | 10.5 | 0 | 9.5 | 0 | 10.5 | 0 | 0 | 0 | 9.5 | 0 | 0 | 0 | 10.5 | 0 | 9.5 | 0 | 60 |

FIG.14

PRINTING APPARATUS AND PRINTING METHOD

BACKGROUND OF THE INVENTION

1. Field of the Invention

The present invention relates to a printing apparatus and printing method and in particular, to controlling of the conveying amount of a printing medium when performing interlace printing.

Furthermore, the invention is applicable in any devices that use printing media such as paper, cloth, leather, non-woven fabric, OHP paper and the like, and even metal. Typical examples of applicable devices are office equipment such as printers, copiers and facsimile machines, and industrial production equipment and so on.

2. Description of the Related Art

The recent popularity of personal computers, word processors, facsimile machines, and so on in offices and at home provides printers of various printing methods as information output devices for those devices. And of them ink Jet printers have the advantages of being easily adapted to color printing, low-level noise when being operated, being capable of printing high quality images on a variety of printing media, and furthermore are easily made compact and so on. This enables ink jet printers to be a suitable information output device for a personal use in offices and at home. And of ink Jet printers, serial scan type ink Jet printing apparatus (hereinafter simply called printing apparatus) that perform printing with a printing head scanning on the printing medium can print high quality images at low cost and have therefore, become widespread throughout the market.

Serial scan type printing apparatuses often adopt a printing method called multi-pass method that can print high quality images. In the multi-pass method, as shown in FIG. 1, a printing head scans (main scan) a certain printing area (A1, A2, . . . ) a plurality of times (three times in the example shown in the FIG.), so that printing for the printing area is complementarily performed through that plurality times of scanning. The number of times which the printing area is scanned leaves multi-pass printing to be called printing performed by multi-passes as in the following: for example, multi-pass printing that performs a three-times main scan over one printing area, as shown in FIG. 1, is called three-pass printing. According to the multi-pass printing, it can reduce or eliminate on the printed images unevenness of density and stripes in the main scanning direction caused by variations in the ejection amount and in the ejecting direction of each ink ejection orifice on the printing head, and white stripes (excessive conveying amount) and black stripes (insufficient conveying amount) resulting from conveying accuracy of conveying printing medium performed between the main scans. It can also reduce or eliminate unevenness of color resulting from ejection orders at the time of bidirectional printing that is caused by arrangement orders of the ejection orifices for each color on the printing head in the main scanning direction. Multi-pass printing can thus improve printed image quality.

In addition to such multi-pass printing, an interlace printing method is used to further improve printed Image quality (Japanese Patent Application Laid-open No. 10-157137). The interlace method forms an array of dots whose intervals are smaller than those of the arranged ejection orifices on the printing head in the sub-scanning direction. More particularly, multi-pass printing conveys is the printing medium by only the amount indicated by (arrangement direction interval between printing elements (e.g., ejection orifice))×N (N: an integer equal to or greater than zero)

between each two of a plurality times of printing, thereby using printing elements different for each of printing by the plurality of times of scanning to complimentarily perform printing. On the other hand, the interlace printing conveys the printing medium by the conveying amount obtained by adding/subtracting 1/M (M: an integer equal to or greater than two) of the arrangement direction interval between the printing elements to/from the reference conveying amount: (arrangement direction interval between printing elements)×N in the case of using the above conveying amount as reference, that is, an amount indicated by (arrangement direction interval between printing elements)×N+1/M (N: an integer equal to or greater than zero, and M: an integer equal to or greater than two), or (arrangement direction interval between printing elements)×N−1/M (N: an integer equal to or greater than zero, and M: an integer equal to or greater than two), and thereby making the interval between scanning lines to which each printing element corresponds by conveying the printing medium less than the arrangement direction interval between printing elements.

According to the above described interlace printing method, gaps between ink dots, particularly in the sub-scanning direction (conveying direction of printing medium) can be filled with ink dots, providing a higher resistance to any shift of the dot position in the sub-scanning direction. More specifically, ink droplets ejected from an ink jet printing head is progressively made smaller with increasing quality of a printed image. On the other hand, the miniaturization and densification of ejection orifices themselves are highly restricted technically and with regard to cost, and thus barely change from those in the conventional manner. For example, it is contemplated that the arrangement direction interval between the ejection orifices be about 42 μm (25. 4 mm/600 pixel), being 1/600 inch to form dots on a printing medium with ink droplets with the diameters of about 32 and 42 μm. When the conveying amount of the printing medium is an Integer-multiple of the arrangement direction interval (42 μm) between the ejection orifices as explained in the multi-pass printing, an image is printed with no gaps when the image is printed with dots aligned in the sub-scanning direction with the diameter of a dot being 42 μm, but on the other hand, when the diameter of the dots is 32 μm, the image is printed with a gap between dots in the sub-scanning direction. If gaps (areas where the image can not be printed) thus exist between dots in the sub-scanning direction, a printed image is sensitively affected when a deviation is made in conveying the printing medium in the sub-scanning direction. That is, the smaller the dots are, the lower the resistance to the deviation in the conveying direction is, which usually makes such a deviation recognizable as unevenness in the image. According to the interlace printing methods it would be able to eliminate possibility of occurrence of such gaps between dots and prevent the unevenness in the Image from occurring due to the positional deviation of dot formation Meanwhile, some ink jet printers select a printing mode that accompanies a change in the conveying amount for each area of the printing medium to be conveyed. For example, so-called margin-less printing is known, wherein the entire parts of a printing paper are used as printing areas without margins. In this printing, when conveying the printing medium such as printing paper, there are printing areas to which printing is performed while the printing medium is conveyed by only one of upstream paired printing medium conveying rollers or downstream paired printing medium conveying rollers, which are provided at an upstream side of the printing areas and at a downstream side, respectively. These printing areas are parts that usually become margins, and are front end and rear end areas of the printing medium, respectively. To these areas printing is performed.

In these areas, however, a conveying accuracy basically deteriorates, and consequently causes deterioration in printing quality, because the printing medium is conveyed by only one set of paired conveying rollers. To avoid the deterioration, when printing is performed for the front end and rear end areas of the printing medium, a selection Is made for a printing mode wherein the number of printing elements to be used is reduced and in addition, the conveying amount of the printing medium is made smaller, which can improve relative conveying accuracy to the printing elements (Japanese Patent Application Laid Open No. 11-291506). In the margin-less printing, printing is performed for each of a front end area, a normal area and a rear end area which is obtained by dividing the printing area on the printing medium into three areas, as shown in FIG. 2.

FIG. 3 is a flow chart showing a process for the margin-less printing. When print data is received in a step S601, the printing medium is fed (step S602) and it is determined whether print data for the front end area exists (step S603). In the case of the existence of the print data, that is, in the case of margin-less printing, a conveying table for the front end area is used to perform printing in the printing mode for the front end area (step S604). When the printing area is determined not to be the front end area in the step S603, the printing area is determined as to whether to be the normal printing area in a step S605. When it is determined to be the normal printing area, a conveying table for the normal area is used to perform printing (step S606). Printing of the printing mode for the normal area is performed until the area is determined not to be the normal printing area any more (step S605). Then, it is determined whether the printing has been completed in a step S607, and if the printing has not been completed, the printing of the printing mode using the conveying table for the rear end area is effected in a step S608.

One example of the conveying tables to be used in each of the printing modes is shown in FIGS. 4A and 4B. These figures show conveying tables in the case of a multi-pass printing method, and taking an example of a case of this method, explain a selection for a printing mode for each area of a printing medium. The number of the ejection orifices (printing element) of a printing head is 128, 60 printing elements among them are used in the front end and rear end areas, and 120 printing elements are used in the normal area. In addition, 16-pass printing that complementarily completes printing of the printing areas with 16 times of scanning is performed in each area. In the tables shown in figures, the conveying amount for each of the 16 times of scanning of phases 0 to 15 is defined for each area In the tables, the conveying amounts are indicated as how many times as long as the interval between printing elements in their arrangement direction as 1. For example, the conveying amount for a phase 0 in the front end area is designated as 10, indicating that the printing medium is conveyed by 10 times as long as the arrangement direction interval between printing elements. When the arrangement direction interval between printing elements is about 42 μm being 1/600 inch, the conveying amount for the phase 0 in the front end area is 420 μm.

In printing that uses the table, the printing medium is conveyed by using the table from the conveying of the printing medium at the phase 0, and with the conveying amount obtained by sequentially shifting a phase by one whenever scanning is performed. For the front end area, first, the printing medium is conveyed by 10 that is the conveying amount of the phase 0, then, the printing head scans in the main scanning direction to perform printing. Next, the phase is shifted by one and the printing medium is conveyed only for the conveying amount zero of the phase 1 (that is, without being conveyed), and then printing is performed while the printing head scans in the main scanning direction. After this, conveying the printing medium and scanning of the printing head are repeatedly performed while similarly shifting the phase only by one. Furthermore, after the phase 15, a return is made to conveying in the phase 0 to continue to perform printing. Although each printing element of the printing head repeatedly scans the same area when the conveying amount is zero, print data in that case is print data obtained by being divided into respective passes of scanning in accordance with the number of these repeated scanning times.

FIG. 4B shows a case where switching is made from the conveying table for the front end area to the conveying table for the normal area at the phase 6 in the table shown in FIG. 4A. More specifically, the printing medium is conveyed up to the phase 5 according to the conveying table for the front end area and the printing medium is conveyed in the phase 6 with the conveying amount of the phase 6 for the normal area.

FIG. 5 is a diagram showing one example of the relation between printing medium conveying including the transfer from the front end area to the normal area and printing head scanning, and showing a case of three-pass printing to simplify an explanation. The conveying amount is 20 in any of the phases of the front end area, and is 40 in any of the phases of the normal area, different from those of the example shown in FIG. 4A. More specifically, reference numerals 701 to 703 designate scans of the printing head for each of passes, and the total number of printing elements of the printing head is 120 which are expressed as equally divided six blocks. Among six equally divided blocks, blocks indicated by horizontal and vertical lines and meshed represent printing elements to be used at the time of printing. Horizontally arranged printing element blocks. e.g., printing element blocks 701*a*, 702*a* and 703*a* complementarily print the images in the three-pass printing.

In the scans 701 to 703, the conveying table for the front end area is used to perform printing, and in the scans 704 to 707, the conveying table for the normal area is used to perform printing. In the scans 701 to 703, since printing is performed with the conveying amount 20 (in three-pass printing), half of all of the printing elements is used. When transfer is made to the normal area on changing to the scan 704, the conveying amount becomes 40 according to the conveying table for the normal area, and the number of printing elements to be used increases, such as the number of printing elements to be used: 80 in the scan 704, 100 in the scan 705, and 120 in the scan 706 and subsequent scans.

As another example of switching the printing mode that accompanies a change in the conveying amounts, processing referred to as the so-called skipping countermeasure is sometimes carried out. Skipping is a phenomenon that the images are disturbed (become uneven) because the conveying amounts sometimes become larger than expected, when the printing medium sandwiched and conveyed by the upstream paired conveying rollers (for example, conveying roller and pinch roller abutted on the conveying roller) is released from the paired rollers. In the skipping countermeasure to prevent the phenomenon, the conveying amounts are temporarily increased in an area where skipping occurs, and the positions of printing elements to be used are greatly changed at the same time to avoid unevenness caused by the skipping.

FIG. 6 is a diagram explaining processing to avoid the skipping, and showing multi-pass printing with the same number of passes as that of the multi-pass printing in FIG. 5. FIG. 6 shows the scans 801 to 805 corresponding to the rear end area, and shows the conveying amounts in the case of printing including skipping countermeasure processing by those scans and the range of printing elements to be used. After printing is performed by the scan 801 (used printing element is indicated by vertical and horizontal line, and meshed block), the printing medium is conveyed by 20 printing element intervals. Then, printing and conveying are carried In the same manner up to the scan 803, and after printing is performed by the scan 803, the conveying amount is set to (20+60) printing element intervals for the skipping countermeasure processing, and the range of printing elements to be used is changed simultaneously (from the lower half of printing head to the upper half). Thus, in the area where skipping occurs, the conveying amounts are made large in advance to avoid the uncertain conveying amount caused by skipping in this way, and then the range of printing elements to be used is changed in accordance with the certain conveying amount of the printing medium. Thereby, the unevenness in the image caused by the skipping can be prevented from occurring.

When the skipping countermeasure processing is carried out, the range of the used printing elements is greatly moved. In this case, unusual printing sometimes occurs if printing is subsequently performed with the range of the used printing elements as it is. For example, in margin-less printing, the printing is generally performed outside the printing medium on printing to the front end and the rear end of the printing medium. For this reason, an absorber is prepared on a platen to absorb ink ejected beyond the printing medium. In this case, since it is general that the printing is performed with printing elements to be used reduced at printing to the front end and rear end of the printing medium, the ink absorber on the platen is provided mostly in accordance with the position of the printing elements to be used when printing is performed to the front end and rear end of the printing medium. Thus, when the skipping countermeasure processing is carried out, the position of the printing elements to be used does not coincide with that of the ink absorber on the platen in some cases. Because of this, after the skipping countermeasure processing is carried out, the range of the used printing elements is required to be returned again to the range of the printing elements to be used before the skipping countermeasure processing.

In interlace printing method, however, unevenness sometimes occurs in the printed images, in the case that switching is simply made to a conveying table which corresponds to the area shown by the example of multi-pass printing as described above. Similarly in the case of skipping, when the range of the used printing elements is returned to the range of the printing elements to be used before the skipping countermeasure processing, unevenness sometimes occurs in the printed images if the processing is simply carried out.

FIGS. 7A to 7C are diagrams showing conveying tables that are used in printing adopting the interlace method in addition to the multi-pass method. The fact that the conveying amount is 10.5 or 9.5 here shows that the printing medium is conveyed with half of the arrangement direction interval between printing elements shifted in the interlace method. In addition, print data is complemented basically with the conveying amount 10.

FIG. 8A shows a relation between printing medium conveying that includes switching a conveying table and printing head scanning, and how printing is performed on the basis of the relation when printing is performed by the interlace method. As shown in FIG. 8A, the interlace printing performs printing while the conveying amount is increased or decreased by 1/N of the arrangement direction interval between printing elements in the sub-scanning direction (N=2 in example shown in FIG. 8A) when printing is performed based on print data that corresponds to the arrangement direction interval between printing elements in the sub-scanning direction. This makes it possible to carry out interlace printing in which dots are formed with 1/N of the arrangement direction interval between printing elements shifted in the sub-scanning direction (N=2 in example shown in FIG. 8A).

FIG. 8A is a diagram showing, by way of example, a case in which printing is performed to the front end area at the time of the margin-less printing. Further, FIG. 8A shows sixteen times of scanning is performed for a unit area consisting of positions 901 and 902 in the sub-scanning direction and an image to be printed to the unit area is completed with the sixteen times of scanning. The positions 901 and 902 are shifted in the sub-scanning direction from each other by ½ of the arrangement direction interval between printing elements.

In printing of the front end area, when print data is received which corresponds to "nozzles to be used" among nozzles as printing elements shown in FIG. 8A, conveying the printing medium is started from the phase 9 of the conveying table shown in FIG. 7A, the printing medium is conveyed with the conveying amount 0 in the phase 9. Then, printing is performed to a position 901 in the sub-scanning direction shown in FIG. 8A with using the nozzle 1512. Next, the printing medium is conveyed with the conveying amount 0 in each case according to phases 10 and 11, and printing is performed to the position 901 in the sub-scanning direction with using the nozzle 1512 similarly to the previous printing in each case. Then, the printing medium is conveyed with the conveying amount 10.5 according to a phase 12, thereby printing is performed to the position 902 in the sub-scanning direction with using the nozzle 1511. Furthermore, after the printing medium is conveyed with the conveying amount 0 according to a phase 13, printing is performed to the position 902 in the sub-scanning direction with using nozzle 1511. Next, when the printing medium is conveyed with the conveying amount 9.5 by a phase 14, printing is performed to the position 901 in the sub-scanning direction again. However, in this printing, the nozzle 1510 is used. After this, printing is performed similarly to the position 901 or 902 in the sub-scanning direction according to a phase 15, a phase 0, . . . , with changing the nozzle used. Thus, printing for an image of the unit area consisting of positions 901 and 902 is completed with the sixteen times of scanning.

An increase or decrease in shift amount of the printing position in the sub-scanning direction is as follows. A shift amount is necessarily −1/N (N=2 in FIG. 8A) in the conveying the printing medium after the printing medium is conveyed to be shifted by +1/N (N=2 in FIG. 8A), and on the contrary, a shift amount is necessarily +1/N (N=2 in FIG. 8A) after the printing medium is conveyed to be shifted by −1/N (N=2 in FIG. 8A), as shown in the example of the conveying table in FIG. 7A. By repeating the above increase or decrease in such shift amounts, the printing can be complementarily printed with the basic conveying amount 10, and the relation between the positions 901 and 902 in the sub-scanning direction which correspond to their own printing elements can be made constant. A shift amount is also increased or decreased in the normal area and the rear end area in the same manner to perform printing as shown by the conveying table in FIG. 7A.

However, when the interlace printing is carried out, there is sometimes a case where a rule of the increase or decrease in the shift amount is not followed as a result of a switching of conveying tables caused by a change in printing areas. In the case that the rule of the increase or decrease is not followed, unevenness occurs in the printed image.

For example, when a switching is made to the table of the normal area from that of the front end area at the phase 5 as shown in FIG. 7B, the printing medium is conveyed In the normal area with the conveying amount 9.5 (phase 6) after being conveyed in the front end area with the conveying amount 10.5 (phase 4) to follow the rule of the increase or decrease in the shift amount. However, when a switching is made to the conveying table of the normal area from the conveying table of the front end area at a phase 7, as shown in FIG. 7C, the printing medium is not conveyed with −1/N, but with +1/N as it is (being conveyed with the conveying amount 10.5 at phase 8 of the normal phase (N=2 in FIG. 8B)) after being conveyed with +1/N (conveying amount 10.5 in phase 4 of front end area (N=2 in FIG. 8B).

When the printing medium is continuously conveyed with the same shift amount +1/N in this way, an image that is printed before or after switching of this continued table is of an image-printed state as shown in FIG. 8B. That is, printing for the unit area consisting of the positions 901 and 902 in the sub-scanning direction is not performed with the sixteen times of scanning, which causes the printed image to have unevenness. More specifically, in scanning after the conveying according to phases 8 and 9 shown in FIG. 8B, normally, the nozzle 1507 used should correspond to the position 901 in the sub-scanning direction and printing should be performed with using the nozzle 1507. However, actually, the nozzle 1507 is located at a position which is deviated from the position 901 in the sub-scanning direction only by (+½) of the printing element arrangement interval×2, as shown by a reference 903. As a result of this, there is a case that the nozzle to be used does not correspond to the position 901 in the sub-scanning direction and then printing is not performed to the position 901 in the sub-scanning direction after the conveyance by the phases 8 and 9. That is, the sixteen pass printing is not performed to the unit area but a fourteen pass printing is actually performed. This phenomenon causes a complementarity of the image for the unit area to be broken, and then causes unevenness in the image. The occurrence of unevenness is not limited to a transfer from the front end area to the normal area, but unevenness sometimes occurs at a transfer from the normal area to the rear end area in the same manner.

In addition, there is a possibility of the occurrence of a similar phenomenon even at the time of shift of the range of printing elements to be used which is post-processing to processing called the skipping countermeasure processing.

SUMMARY OF THE INVENTION

The object of the present invention is to provide a printing apparatus and a printing method capable of printing an image without causing unevenness in the image when switching is made to a conveying table for printing medium conveying to perform the interlace printing.

In the first aspect of the present invention, there is provided a printing apparatus that uses a printing head, in which a plurality of printing elements are arranged, to perform printing to a printing medium, the apparatus comprising:

scanning means for scanning the printing head over the printing medium in a direction different from a direction in which the plurality of printing elements are arranged;

conveying means for conveying the printing medium between successive scans by the scanning means, the conveying means using a conveying table in which one of a plurality of conveying amounts including at least a first or second amount that is not an integer-multiple of an interval between the printing elements arranged in the arrangement direction is defined for each scanning, to refer to the conveying amount corresponding to each scanning for conveying the printing medium; and switching means for switching the conveying table to be used, wherein the switching means controls the switching of conveying table so that the conveying amount, which is not the integer-multiple of the interval and is defined for the scan closest to an execution of the switching among the scans before the switching, is not the same as the conveying amount, which is not the integer-multiple of the interval and is defined for the scan closest to an execution of the switching among the scans after the switching.

In the second aspect of the present invention, there is provided a printing apparatus that uses a printing head, in which a plurality of printing elements are arranged, to perform printing to a printing medium, the apparatus comprising:

scanning means for scanning the printing head over the printing medium in a direction different from a direction in which the plurality of printing elements are arranged;

conveying means for conveying the printing medium between successive scans by the scanning means, the conveying means using a conveying table in which one of a plurality of conveying amounts including at least a first or second amount that is not an integer-multiple of an interval between the printing elements arranged in the arrangement direction is defined for each scanning, to refer to the conveying amount corresponding to each scanning for conveying the printing medium; and switching means for switching the conveying table to be used, wherein the switching means does not switch the conveying table when the conveying amount, which is not the integer-multiple of the interval and is defined for the scan closest to an execution of the switching among the scans before the switching, is the first or second conveying amount, and the conveying amount, which is not the integer-multiple of the interval and is defined for the scan closest to an execution of the switching among the scans after the switching is the same as the first or second conveying amount before the switching.

In the third aspect of the present invention, there is provided a printing method that scans a printing head, in which a plurality of printing elements are arranged, relatively to the printing medium in a direction different from a direction in which the plurality of printing elements are arranged, to perform printing to the printing medium by means of the printing head, the method comprising the steps of:

conveying the printing medium for using a conveying table in which one of a plurality of conveying amounts including at least a first or second amount that is not an integer-multiple of an interval between the printing elements arranged in the arrangement direction is defined for each scanning to refer to the conveying amount corresponding to each scanning to conveying the printing medium; and switching the conveying table to be used, wherein the switching step controls the switching of conveying table so that the conveying amount, which is not the integer-multiple of the interval and is defined for the scan closest to an execution of the switching among the scans before the switching, is not the same as the conveying amount, which is not the integer-multiple of the interval and is defined for the scan closest to an execution of the switching among the scans after the switching.

In the fourth aspect of the present invention, there is provided a printing method that scans a printing head, in which a plurality of printing elements are arranged, relatively to the printing medium in a direction different from a direction in which the plurality of printing elements are arranged, to perform printing to the printing medium by means of the printing head, the method comprising the steps of:

conveying the printing medium for using a conveying table in which one of a plurality of conveying amounts including at least a first or second amount that is not an integer-multiple of an interval between the printing elements arranged in the arrangement direction is defined for each scanning, to refer to the conveying amount corresponding to each scanning to conveying the printing medium; and switching the conveying table to be used, wherein the switching step does not switch the conveying table when the conveying amount, which is not the integer-multiple of the interval and is defined for the scan closest to an execution of the switching among the scans before the switching, is the first or second conveying amount, and the conveying amount, which is not the integer-multiple of the interval and is defined for the scan closest to an execution of the switching among the scans after the switching is the same as the first or second conveying amount before the switching.

According to the above configuration, when switching of the conveying tables, in accordance with a printing area, in which one of a plurality of the conveying amounts including at least the first or second amount as the conveying amount that is not an integer-multiple of the printing element direction interval is determined for each scanning, the first or second conveying amount is prevented from being continuously used. Thereby, it is possible to reduce deviation from a printing position in the printing element arrangement direction before and after switching conveying tables. Consequently, it would be able to perform printing in which unevenness is reduced sufficiently when the switching is made to the conveying tables to carry out the interlace printing.

The above and other objects, effects, features and advantages of the present invention will become more apparent from the following description of embodiments thereof taken in conjunction with the accompanying drawings.

BRIEF DESCRIPTION OF THE DRAWINGS

FIGS. 4A and 4B are diagrams that show one example of the conveying tables to be used for the margin-less printing which uses the multi-pass printing method;

FIGS. 7A to 7C are diagrams that describe the conveying tables relating to the first embodiment of the present invention, and switching of the conveying tables between printing areas;

FIG. 13 is a diagram that shows a conveying table to be used in a second embodiment of the present invention; and FIG. 14 is a diagram that shows a conveying table to be used in a third embodiment of the present invention.

DETAILED DESCRIPTION OF PREFERRED EMBODIMENTS

Hereinafter, with reference to the accompanying drawings, the embodiments will be described in accordance with the present invention in detail.

In the following embodiments, a printer that uses an ink jet type printing head is taken as an example to describe the embodiments. Furthermore, "printing", in the specification, represents a case where significant information is formed, such as characters and diagrams, as well as a case where an image, a design, a pattern and the like are formed on a printing medium broadly without regard to whether significant or insignificant, and without regard to whether explicit enough for a person to visually recognize them, or a case where a medium is processed. In addition, a "printing medium" does not only represent paper which is used by a general printer, but also, broadly represents a printing medium which can accept ink, such as cloth, a plastic film, a metallic plate, glass, a ceramic, wood and leather. Then, "ink" (sometimes called "liquid") should be widely interpreted in the same manner as the definition of the "printing" and represents liquid which is applicable to the formation of an image, a design, a pattern and so on, the working of a printing medium, or ink processing (for example, coagulation or insolubility of colorant in ink to be applied to printing medium). Still furthermore, a "nozzle" generally represents an ejection orifice, a liquid path communicating with the ejection orifice, and an element which generates energy to be used to eject ink, as long as not mentioned especially.

Figure 9:
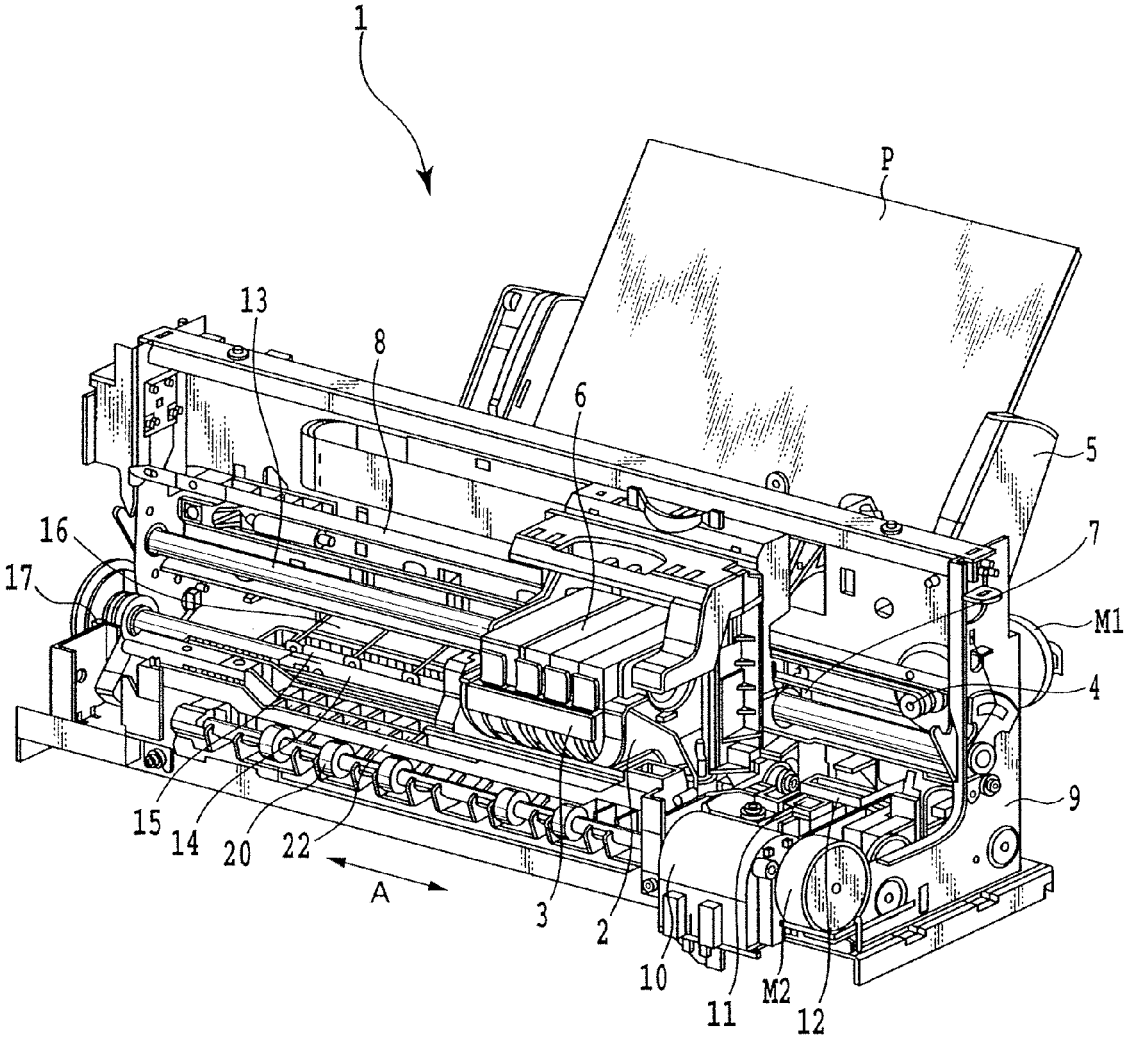
FIG. 9 is a perspective view that shows an outline configuration of an ink jet printer which relates to one embodiment of the present invention.

FIG. 9 is perspective view that shows an outline configuration of an ink jet printer 1 which relates to the first embodiment of the present invention.

As shown in FIG. 9, the ink jet printing apparatus (hereinafter called printing apparatus) transmits driving force generated by a carriage motor M1 to a carriage 2 on which a printing head 3 that ejects ink according to an ink jet system to print an image is mounted by a transmission mechanism 4, reciprocates the carriage 2 in the direction of an arrow A, feeds a printing medium P, for example, printing paper and so on through a paper feeding mechanism 5 to convey the printing medium P up to a printing position, and prints an image by making the printing head 3 eject ink onto the printing medium P at the printing position.

The printing head 3 is mounted on the carriage 2 of the printing apparatus 1 and in addition, an ink cartridge 6 that stores ink to be supplied to the printing head 3 is mounted. The ink cartridge 6 is detachable from the carriage 2. The printing apparatus 1 of the embodiment can print a colored image, so that four ink cartridges respectively housing magenta (M), cyan (C), yellow (Y) and black (B) are mounted on the carriage 2 for color printing. The four ink cartridges are independently detachable respectively.

The carriage 2 can be electrically connected to the printing head 3 because joint surfaces of the both members abut on each other properly, making it possible to maintain required electrical connection. The printing head 3 applies energy in response to a print signal to thereby selectively eject ink from a plurality of the ejection orifices, printing an Image. The printing head 3 of the embodiment especially adopts the ink jet system that utilizes thermal energy to eject ink, is provided with an electro-thermal conversion system to generate thermal energy, and utilizes change of pressure caused by the growth and contraction of air bubbles created by film boiling that is caused by converting electric energy applied to the electro-thermal conversion system Into thermal energy to give the thermal energy to ink, which ejects the ink from the ejection orifice. The electro-thermal conversion system is provided so as to correspond to the ejection orifices respectively, and the ink is ejected from the ejection orifice by applying pulse voltage to electro-thermal conversion system corresponding in response to the print signal.

Figure 10:
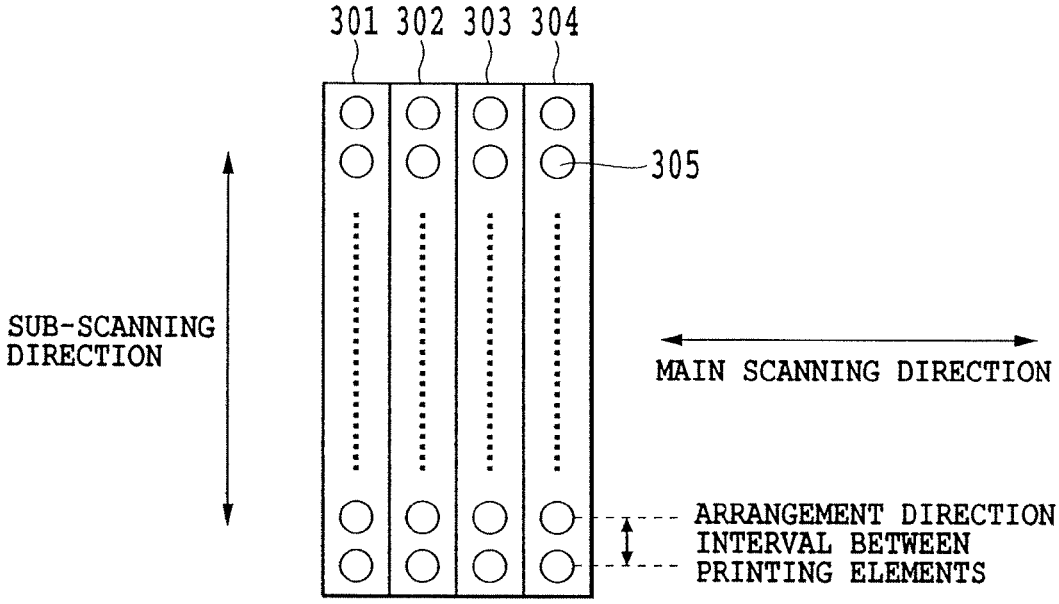
FIG. 10 is a schematic printing head view that shows one example of a printing head to be used in the device shown FIG. 9.

The printing head of the embodiment, as shown in FIG. 10, uses the so-called horizontally arranged printing heads, wherein the printing heads 3 for respective colors to be used for printing are provided along the main scanning direction to respectively eject ink droplets to corresponding rasters from the ejection orifices of each printing head in the same print scanning. The printing head uses cyan, magenta, yellow and black as colors to be used for printing, and is provided with a printing head 301 for cyan, a printing head 302 for magenta, a printing head 303 for yellow and a printing head 304 for black, each of the printing heads consisting of 128 ejection orifices (printing elements) 305, as shown in FIG. 10.

With reference to FIG. 9 again, the carriage 2 is connected to a portion of a driving belt 7 of the transmission mechanism 4 that transmits the driving force of the carriage motor M1 to be guided and supported slidably along a guide shaft 13 in the direction of the arrow A. This enables the carriage 2 to reciprocate along the guide shaft 13 by the normal rotation and reverse rotation of the carriage motor M1. The carriage 2 is provided with a scale 8 for indicating an absolute position of the carriage 2 along the moving directions (direction of arrow A) of the carriage 2. In the embodiment, the scale 8 is obtained by printing black bars on a transparent PET film at required pitches, wherein one end of the scale 8 is fixed to a chassis 9, and the other is supported by a plate spring (not shown).

The printing apparatus 1 is also provided with the platen (not shown) at the position that is faced by the ejection orifice-surface with the ejection orifices (not shown) of the printing head 3 formed thereon when the printing head 3 scans to thereby be able to print an image is over the full width of the printing medium P conveyed on the platen. In addition, an ink absorber is provided at prescribed places for margin-less printing in accordance with the platen.

In FIG. 9, reference numeral 14 denotes conveying rollers that are driven by a conveying motor M2 to convey the printing medium P, reference numeral 15 denotes pinch rollers for making the printing medium P abut on the conveying rollers 14 by a spring (not shown), reference numeral 16 denotes pinch roller holders for supporting the pinch rollers 15 rotatably, and reference numeral 17 denotes conveying roller gears fixed to one end of the conveying rollers 14, respectively. The conveying rollers 14 are rotatably driven by the driving force of the conveying motor M2 transmitted to the conveying roller gears 17 through intermediate gears (not shown). Furthermore, reference numeral 20 denotes discharging rollers for discharging the printing medium P out of the printing apparatus, and the driving force of the conveying motor M2 is transmitted to rotate the discharging rollers. Spur rollers (not shown) that generate pressing force by a spring (not shown) are abutted on the discharging rollers 20 to thereby be able to sandwich the conveyed printing medium P, pressing the printing medium P against the discharging rollers. Reference numeral 22 denotes a spur holder that rotatably supports the spur rollers.

Figure 1:
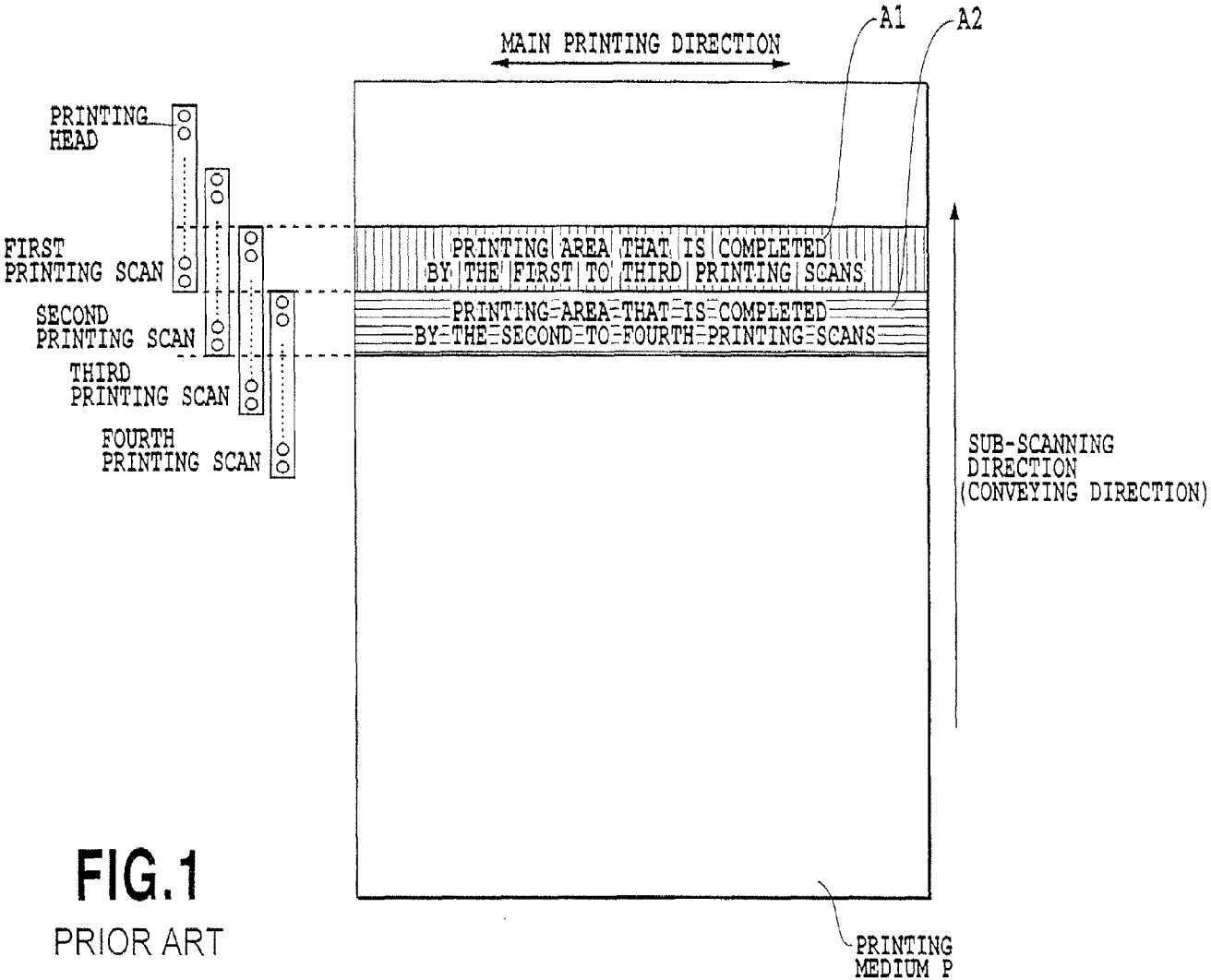
FIG.1 PRIOR ART
FIG. 1 is a diagram that describes the multi-pass printing.
Figure 2:
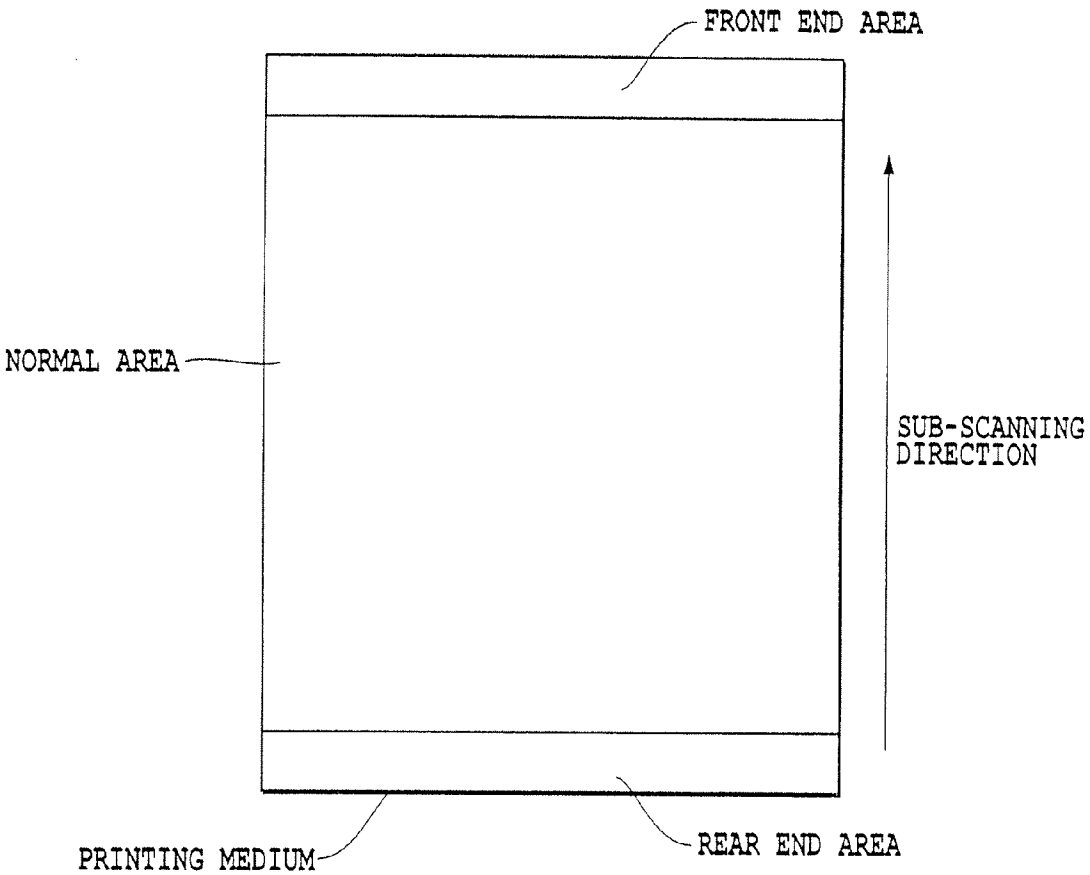
FIG.2 PRIOR ART
FIG. 2 is a diagram that describes the divided printing areas of the printing medium in the margin-less printing.

When performing the margin-less printing in the printing apparatus of the above configuration, printing is performed to the normal area, the front end area and the rear end area, as shown in FIG. 2. Definitions of "normal area", "front end area" and "rear end area" may be described as follows.

First, "front end area" is an area to which printing is performed before a front end of a printing medium is held by a pair of rollers at the downstream side of a scan area by the printing head. That is, "front end area" is an area to which printing is performed in a condition that the printing medium is not held by the pair of rollers at the downstream side of a scan area by the printing head but held by a pair of rollers at the upstream side of a scan area by the printing head.

Next, "rear end area" is an area to which printing is performed after a rear end of the printing medium is left from the pair of rollers at the upstream side. That is, "rear end area" is an area to which printing is performed in a condition that the printing medium is not held by the pair of rollers at the upstream side but held by the pair of rollers at the downstream side.

Finally, "normal area" means an area except "front end area" and "rear end area", and Is an area to which printing is performed in a condition that the printing medium is held by both the pair of rollers at the upstream side and the pair of rollers at the downstream side.

In the embodiment, the pair of rollers at the downstream side corresponds to the pair of the discharging roller 20 and the spur roller shown in FIG. 9, and the pair of rollers at the upstream side corresponds to the pair of the conveying roller 14 and the pinch roller 15 shown in FIG. 9.

As described later, the present embodiment switches the conveying tables at the time when transfer is made from the front end area to the normal area and the time when transfer is made from the normal area to the rear end area. For executing the switching of the conveying tables, it is necessary to determine which area is subject to printing among the front end area, the normal area and the rear end area, and to detect timing of the transferring from the front end area to the normal area or the transfer from the normal area to the rear end area. The present embodiment obtains information on a position of the printing medium on a conveying path, and based on the positional information obtains information indicating that the area now subject to printing is the front end area, the normal area or the rear end area. Then, the present embodiment detects the timing of the transferring from the front end area to the normal area or the transferring from the normal area to the rear end area, based on the obtained information. A method of obtaining information on a position of the printing medium on a conveying path is well known and of common use, description thereof is omitted.

Figure 11:
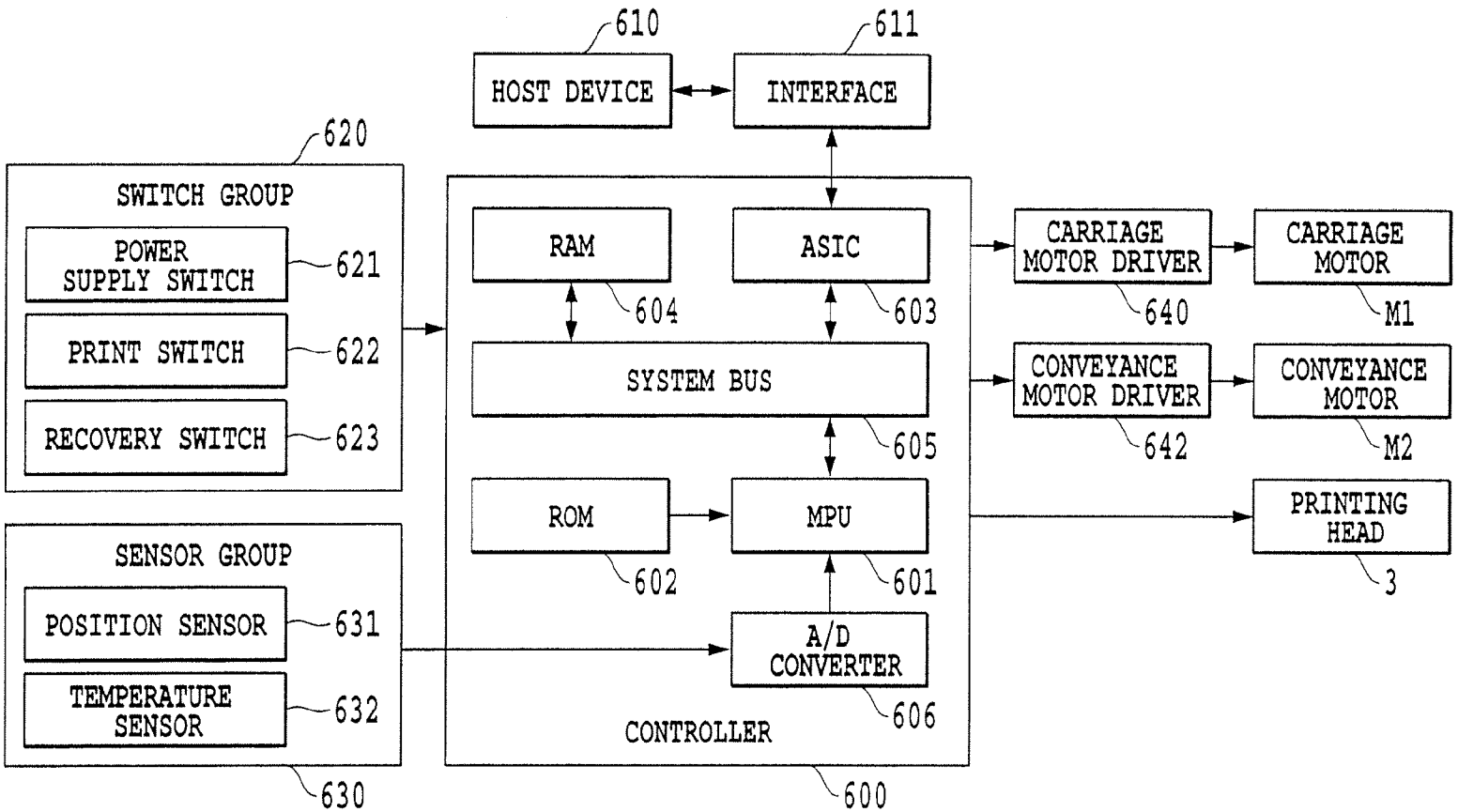
FIG. 11 is a block diagram that shows the configuration of a control circuit of the ink jet printer shown in FIG. 1.

FIG. 11 is a block diagram that shows a control configuration of the printing apparatus shown in FIG. 9.

As shown in FIG. 11, a controller 600 comprises an MPU 601, a ROM 602 for storing a program that coffesponds to a control sequence to be described later in FIG. 12, required tables such as a conveying table, and the other data, an application-specific integrated circuit (ASIC) 603 for generating a control signal for control over the carriage motor M1, control over the conveying motor M2, and control over the printing head 3, a RAM 604 provided with a storage area for image data, a working area for program execution and so on, a system bus 605 that connects the MPU 601, the ASIC 603 and the RAM 604 to each other to exchange data, an A/D converter 606 for receiving an analog signal from a sensor group to be explained below to convert the analog signal to a digital signal, supplying the digital signal to the MPU 601, and so on.

In FIG. 11, reference numeral 610 denotes a computer that is a supply source for image data as a host device.

The computer is not limited to this example as a host device, and can be, for example, a reader for reading an Image, a digital camera and so on. The host device 610 and the printing apparatus 1 transmit and receive image data, a command, a status signal and so on to/from each other through an interface (I/F) 611. Reference numeral 620 denotes a switch group and consists of switches for receiving command inputs made by an operator, such as a power supply switch 621, a print switch 622 for instructing a printing start, and a recovery switch 623 for instructing to start recovery processing to maintain ink ejection performance of the printing head 3 in a satisfactory state. Reference numeral 630 denotes a sensor group and consists of a position sensor 631, such as a photo-coupler for detecting a home position and a temperature sensor 632 provided at an appropriate place to detect ambient temperature, which detects states of the device.

Furthermore, reference numeral 640 denotes a carriage motor driver that controls the driving of the carriage motor M1 for reciprocating the carriage 2, and reference numeral 642 denotes a conveying motor driver that controls the driving of the conveying motor M2 for conveying the printing medium P, respectively.

In the above configuration, a printing apparatus main body analyzes a command of data for printing transferred from the host device 610 through the interface 611 and stores the print data to be used for printing in the RAM 602. The ASIC 603 transfers ejection data of a printing element (ejection heater) to the printing head while directly accessing a printing area of the RAM 602.

Figure 12:
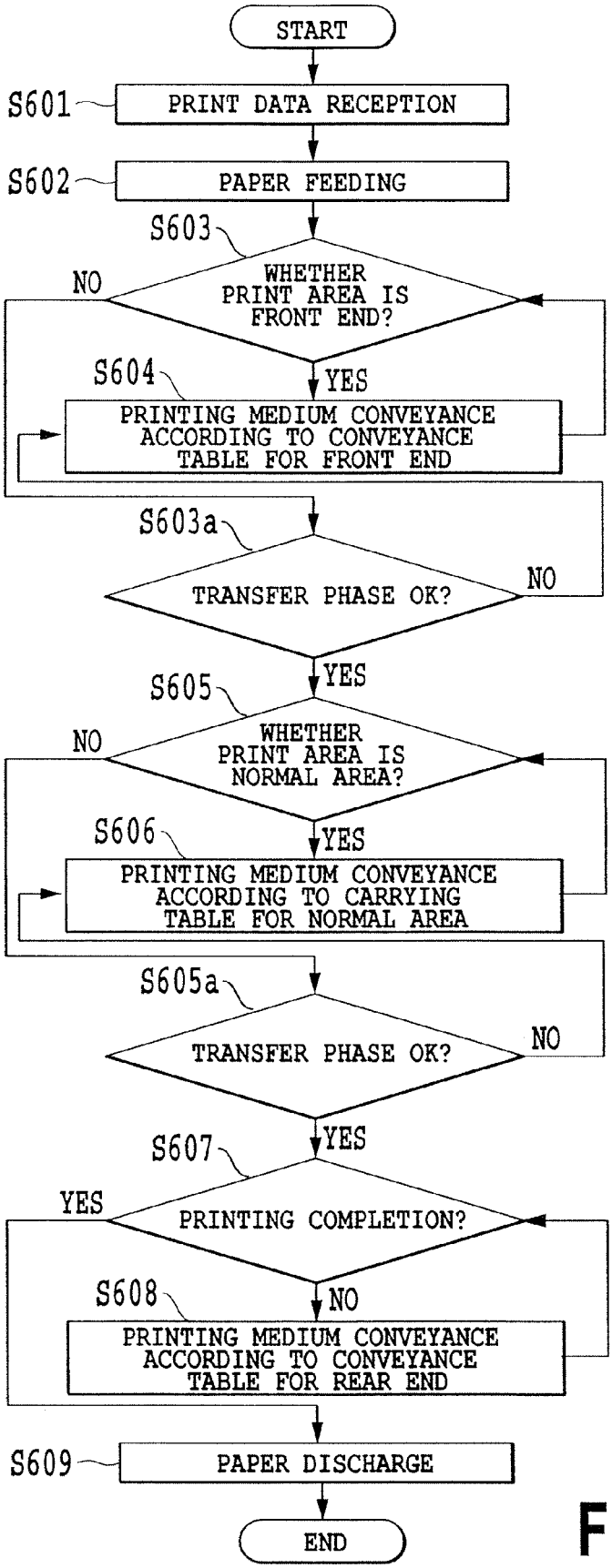
FIG. 12 is a flow chart that shows the interlace printing relating to the first embodiment of the present invention.

Next, control processing In the printing apparatus with the configuration is described First Embodiment FIG. 12 is a flow chart showing a printing operation according to the first embodiment of the present invention, especially showing conveying processing of the printing medium. In FIG. 12, the same step numbers are given to steps which are the same as those described with reference to FIG. 3, and descriptions thereof are omitted.

Figure 3:
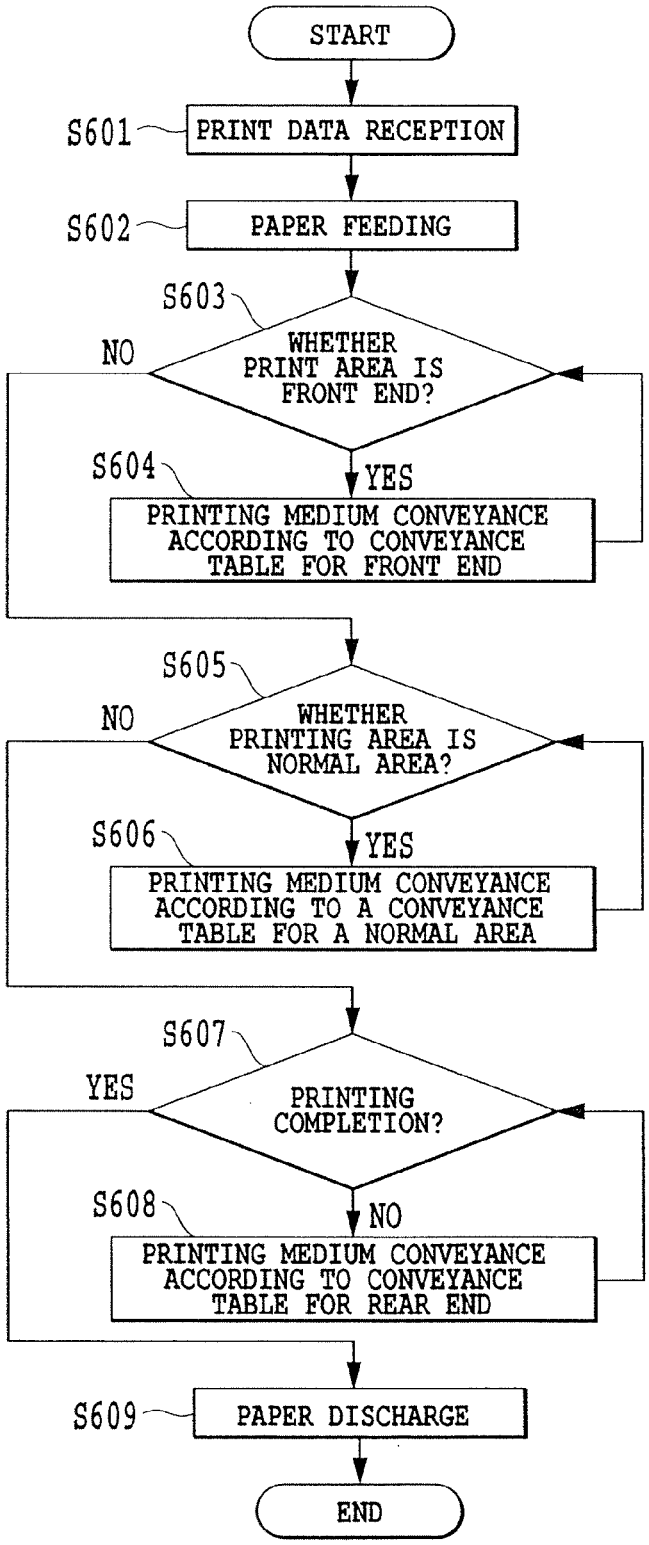
FIG.3 PRIOR ART
FIG. 3 is a flow chart that shows a processing procedure for the margin-less printing.
Figure 5:
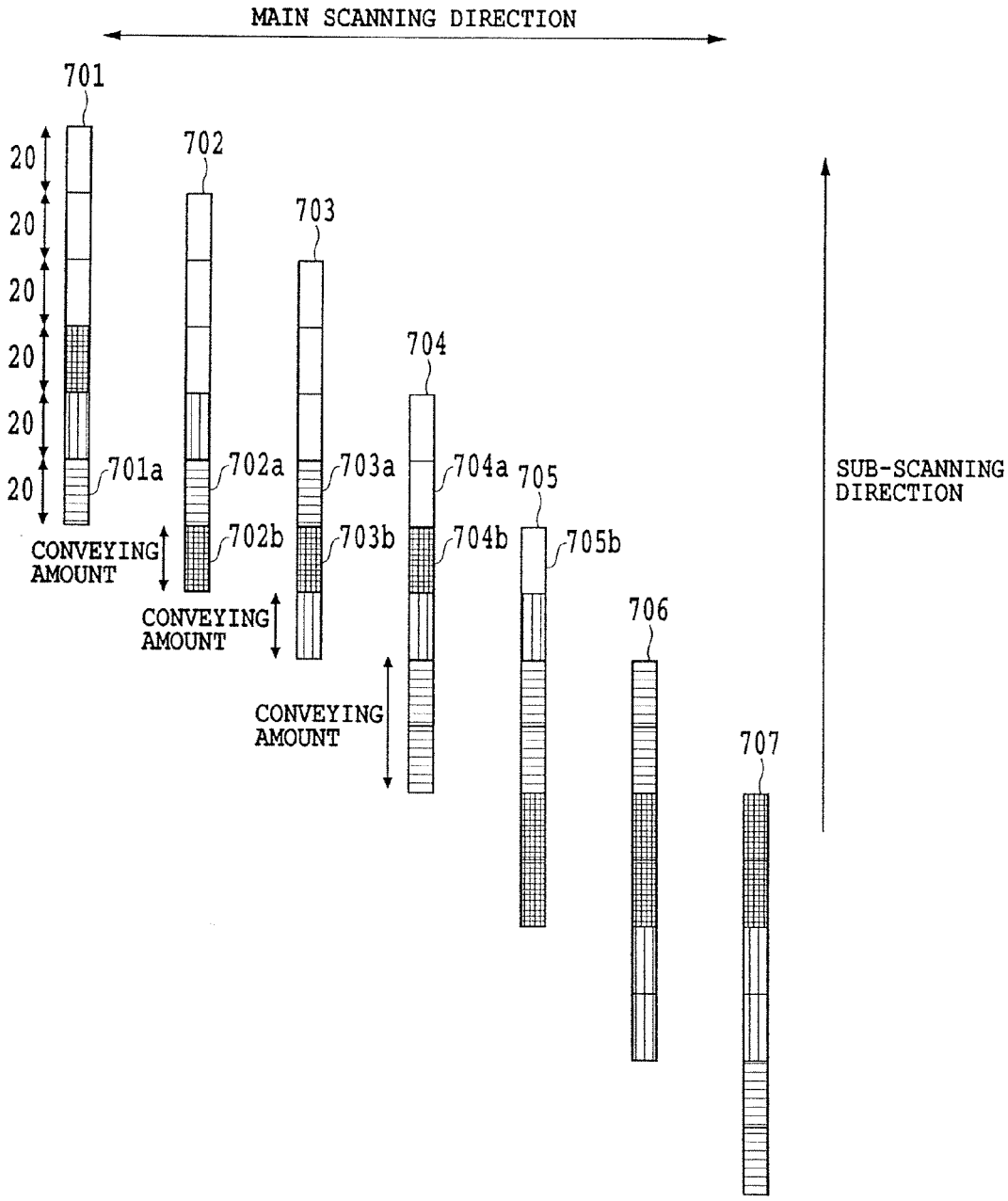
FIG.5 PRIOR ART
FIG. 5 is a diagram that describes a change in number of printing elements to be used in accordance with transfer to a printing area.
Figure 6:
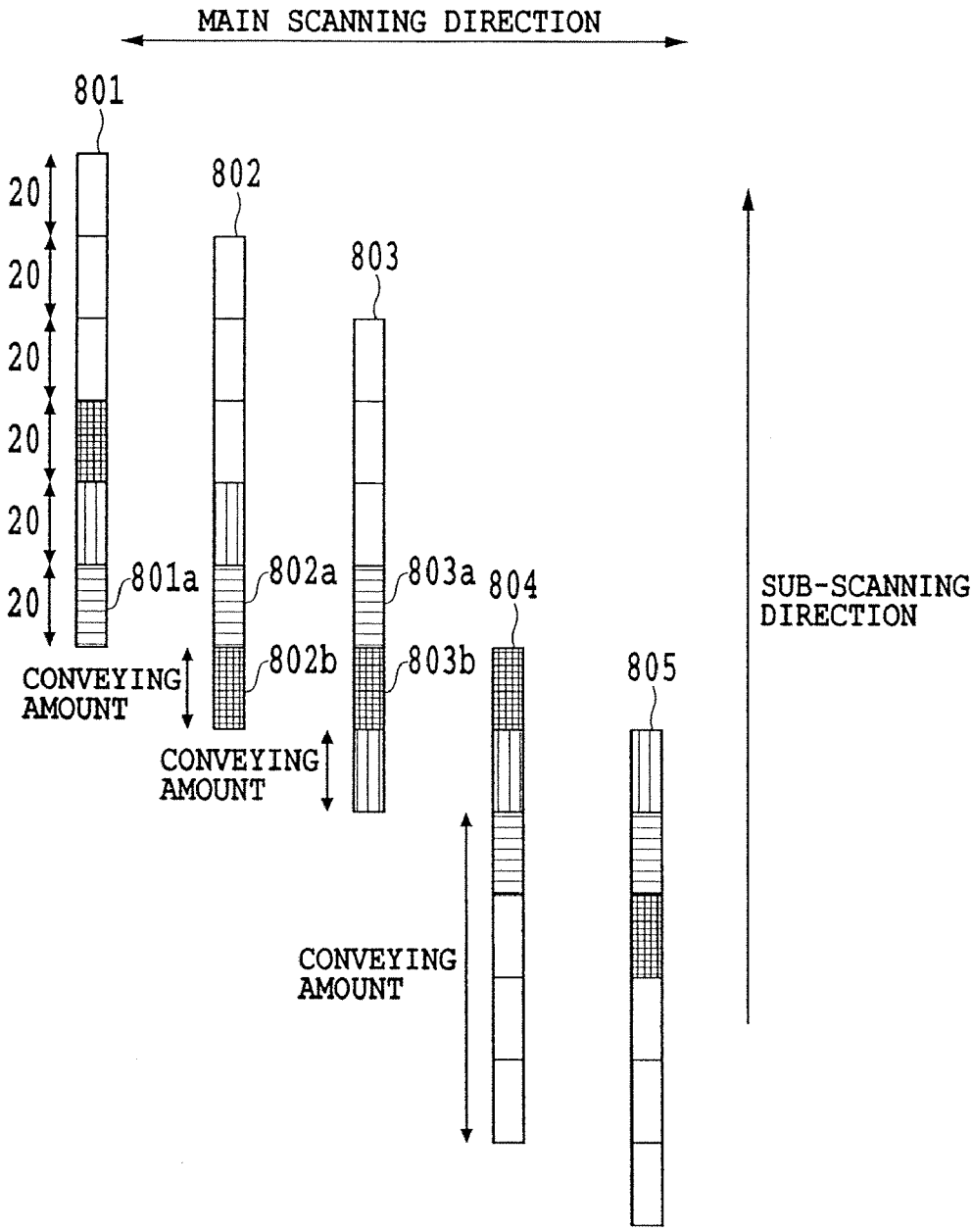
FIG. 6 is a diagram that describes a change in position of the printing elements to be used in accordance with the skipping countermeasure processing.

Differences from processing shown in FIG. 3 are processing of steps S603*a* and S605*a*. In the step S603*a*, it is determined what a phase is in a conveying table at the time of transfer from the front end area to the normal area, and whether the phase is a transfer inhibition phase. That is, when the phase is any of phases 6 to 9 in the table shown in FIG. 7A, the phase is determined to be the transfer inhibition phase. When the phase is determined to be the transfer inhibition phase, a return is made to a step S604 to continue printing that uses the conveying table for the front end area. When the phase is determined not to be the transfer inhibition phase, an advance is made to determination in a step S605. The transfer inhibition phase is, as shown in FIG. 7C, a phase wherein an interlace shift amount +1/N or −1/N continues, and prevents the rule of the increase or decrease in the shift amount from being followed when transfer is made from that phase to the next phase (phase obtained by adding one) in the normal area. Here, the conveying amounts that correspond to an integer-multiple of the arrangement direction interval between printing elements, for example, 0 and 10 are omitted. The reason is that the shift amount +1/N or −1/N is unaffected even if the printing medium is conveyed with the conveying amount that corresponds to the integer-multiple of the arrangement direction interval between printing elements. The transfer inhibition phase is determined as follows. When +1/N or −1/N is used as the closest shift amount before switching the table and the same conveying amount +1/N or −1/N is used as the closest shift amount after the switching the table, respectively, the phase (preceding phase) at the switching is determined to be the inhibition phase. More specifically, the object is to inhibit such a transfer where the printing medium is conveyed by 9.5 again after being conveyed by 9.5, or the printing medium is conveyed by 10.5 again after being conveyed by 10.5 because of the transfer. Even if the printing medium is conveyed by (0 or 10) that corresponds to an integer-multiple of the arrangement direction interval between printing elements between 9.5 and 9.5, or between 10.5 and 10.5, the integer-multiple conveying is not considered as the shift amount. In the step S605*a* to determine a phase for transferring from the normal area to the rear end area, it is similarly determined whether the phase is the transfer inhibition phase, and when the phase is the transfer inhibition phase (any of phase 6 to 9 in FIG. 7A), a return is made to a step S606 to continue printing that uses the conveying table for the normal area. When the phase is not the transfer inhibition phase, an advance Is made to determination in the step S605.

Figure 8A:
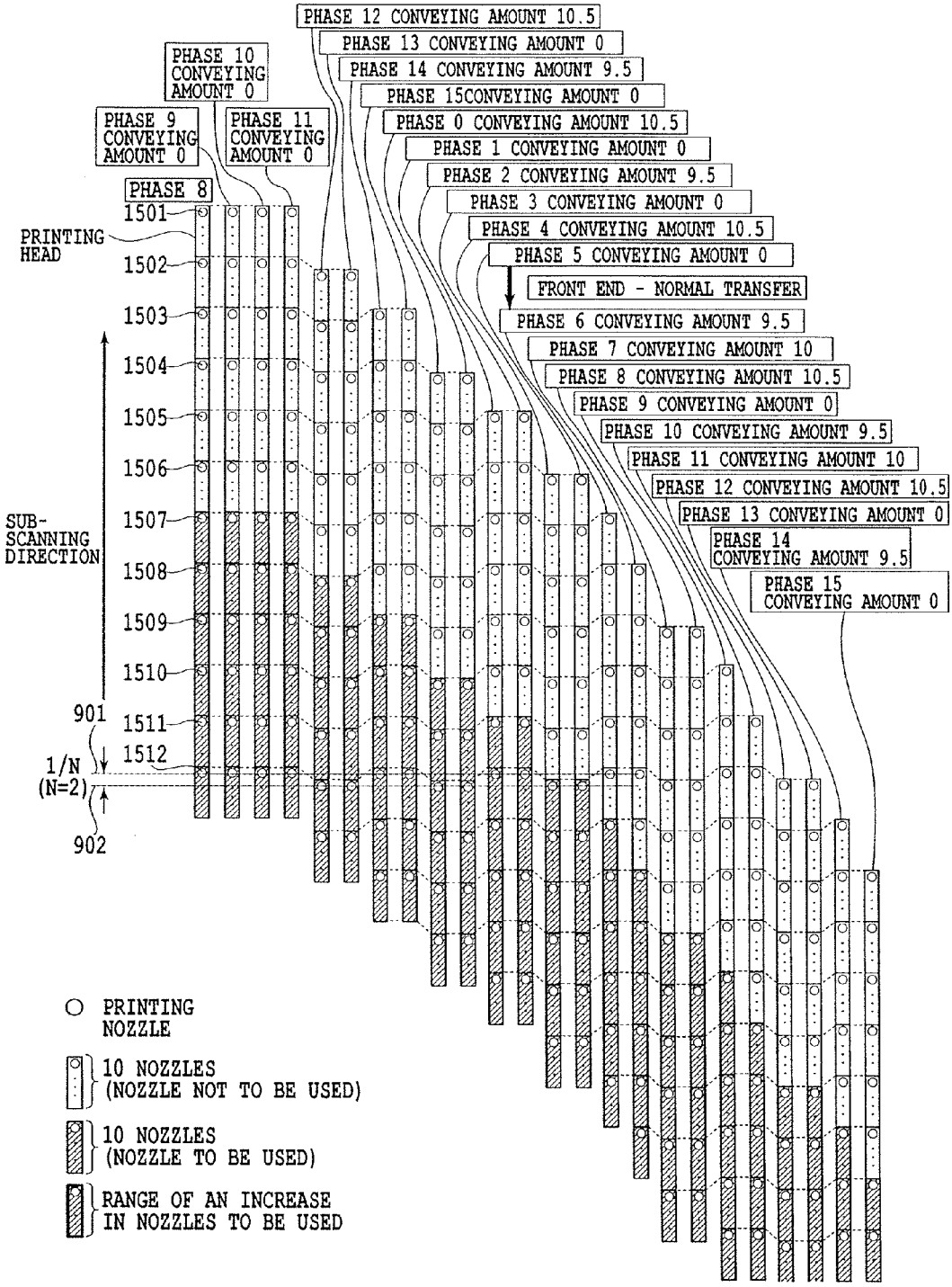
FIGS. 8A and 8B are diagrams that describe the interlace printing and shift of printing positions caused by switching of conveying tables at the time of the interlace printing.
Figure 8B:
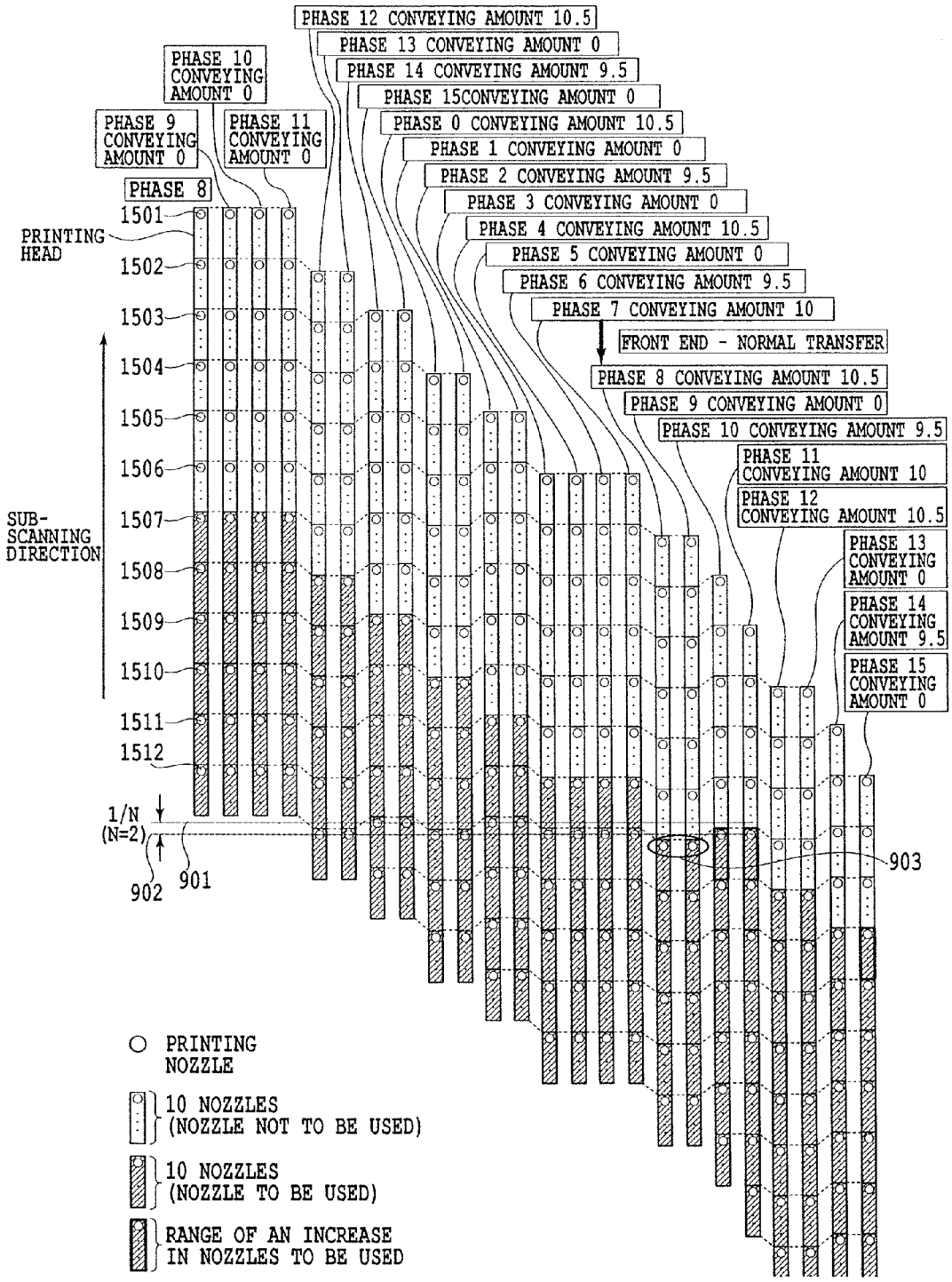

Thus, it is possible to specify the switching of the conveying tables so as not to continue the shift amount +1/N (N=2 in FIGS. 8A and 8B) or −1/N (N=2 in FIGS. 8A and 8B) by determining whether a phase of the conveying table is the transfer inhibition phase in transferring of the printing area. This can prevent the occurrence of unevenness in an Image due to 1/N deviation of a printing position with respect to print data in the sub-scanning direction when the transfer is made from the front end area to the normal area or from the normal area to the rear end area, as described in FIG. 8B.

Second Embodiment

In the first embodiment, it is described how the present invention is applied to a transfer from the front end area to the normal area or the normal area to the rear end area. However, there is also a case where 1/N (N=2 in FIG. 8B) deviation of a printing position in the sub-scanning direction with regard to the printing elements occurs when the range of the printing elements is returned after the skipping countermeasure processing. Even in such a case, similarly to the first embodiment, it is possible to prevent the deviation from occurring by providing a transfer inhibition phase.

FIG. 13 is a diagram showing conveying tables for the rear end area and for conveying of the return processing. In the conveying table according to which the range of printing elements to be used is returned (the range of printing elements to be used is changed), there is a difference in a phase 0 and a phase 2 from the conveying table for the rear end area shown in the FIG. 13, so that in the return table, the conveying amount is set to zero in the respective phases. In these phases 0 and 2, the range of printing elements to be used is changed in the phases 0 and 2 by shifting the correspondence relation of the print data to the printing elements as much as complementary width of image data (10 in example shown in FIG. 13), without conveying the printing medium. The printing is performed while using the conveying table for the change (return) of the range of printing elements to be used, and when the range of printing elements to be used is completely changed (returned) by a desired amount (60 in the embodiment), a switching is made to the conveying table for the rear end area again.

In the above configuration, since a switching from the conveying table of the rear end area to the return conveying table at the phases 1 and 2 causes 1/N deviation, the switching of the conveying tables is inhibited at the phases 1 and 2. This can prevent the occurrence of 1/N deviation of the printing position in the sub-scanning direction which occurs when switching from the conveying table for the rear end area to the conveying table for return processing for skipping processing is performed.

Third Embodiment

Both in the first and second embodiments, transfer inhibition phases are provided. Therefore, a printing speed may decrease. More specifically, the number of printing elements to be used at the time of front end area printing is set to be smaller than the number of printing elements to be used at the time of normal area printing (front end area: 60, and normal area: 120 in example shown in FIG. 7A). As a transfer is made from the front end area to the normal area earlier, the earlier the number of printing elements to be used can be increased to be able to increase a printing speed. In the first and second embodiments, however, there is sometimes a case where a printing speed decreases because the transfer inhibition phases are provided to thereby delay transferring to the normal area from the front end area.

FIG. 7A is used as an example. After the printing medium is conveyed up to the phase 4 in the front end area, it is determined whether the phase 4 is the transfer inhibition phase to determine the transfer to the normal area. As described about the first embodiment, since the transfer inhibition phases in the table of FIG. 7A are phases 6 to 9, a switching is made to the conveying table of the normal area in the phase 5 in this case to convey the printing medium with the conveying amount 9.5. In this case, the transfer from the front end area to the normal area is determined and permitted at the same time, which accordingly does not drop a printing speed.

On the other hand, it is determined whether the phase 6 is the transfer inhibition phase to determine a transfer from the front end area to the normal area when the printing medium is conveyed completely in the phase 6. Although the printing medium can be conveyed with the conveying amount 10 if a switching is made to the conveying table for the normal area (phase 7), because of the transfer inhibition phase, in this case, the printing medium is continuously conveyed according to the conveying table for the front end area, that is, with the conveying amount 0. Furthermore, the transfer inhibition phase continues in phases 7, 8 and 9 to therefore increase an area to be printed according to the conveying table for the front end area. This makes the printing speed lower than a case where the switching is determined and made to the conveying table for the normal area at the same time.

With regard to a transfer from the normal area to the rear and area, it is expected that the printing speed becomes higher contrary to a transfer from the front end area to the normal area, because transfer inhibition phases are provided to increase printing that uses the conveying table for the normal area. However, it is actually required, in the rear end area, that a transfer is made completely, up to a predetermined position, to the table for the rear end area to cause the need to set a transfer position to the table for the rear end area, consequently bringing about a possibility of making the printing speed lower with the regard to the transfer from the normal area to the rear end area.

Therefore, in the embodiment unlike the first and second embodiments, a transfer phase is not inhibited, but a transfer destination phase is designated. This can prevent the printing speed from getting lower.

FIG. 14 is a diagram showing conveying tables used in the present embodiment, and showing conveying tables indicating the conveying amount for each phase and tables indicating the transfer destination phase for each phase about the respective front end, normal and rear end areas.

In the first embodiment, when a switching is attempted to the conveying table for the normal area after the printing medium is conveyed completely, for example, up to the phase 6 according to the conveying table for the front end area, the switching to the conveying table for the normal area is not performed because the next phase 7 is the transfer inhibition phase. On the other hand, after the printing medium is conveyed up to the phase 6 according to the conveying table for the front end area, a transfer is made to the phase 6 in the conveying table for the normal area by referring the transfer destination phase of the conveying table for the front end area, as shown in FIG. 14, to convey the printing medium with the conveying amount 9.5.

This prevents the occurrence of a decrease in throughput, which is possible at transfer in the first and second embodiments, because the transfer destination phase of the conveying table is designated at time of area transfer to make it possible to switch to the conveying table.

The embodiments describe a change in position of printing elements to be used after transfer of a printing area to each place of the front end area, the normal area and the rear end area, and after the execution of skipping processing. However, the present invention does not have to be limited to these examples, but can be applied similarly to each transfer place in the configuration of the existence of places where the number of printing elements to be used or the range of printing elements to be used is changed in interlace printing.

In the designation of a transfer inhibition phase, a prescribed phase that is predetermined is transfer inhibition in the embodiments, the transfer inhibition phase may be obtained by calculation.

Furthermore, complementary printing width is a constant in the first to third embodiments. However, the object of the present invention is definitely to make a shift amount after shifting by +1/N to be −1/N (N=2 in FIG. 9) in an increase/decrease in the sub-scanning direction, and a shift amount after shifting by −1/N to be +1/N, therefore, the complementary printing width does not have to be always constant.

(Others)

In all the embodiments, to simplify description, a printing head has one row of use ejection orifices, and the use ejection orifices are aligned in the sub-scanning direction. However, it is taken for granted that a similar effect is obtainable in the case of a printing head provided with a plurality of rows of ejection orifices that correspond to different colors, a printing head provided with a plurality of rows of ejection orifices even for one color, or a printing head with the direction of aligned ejection orifices slanted to the sub-scanning direction and the main scanning direction. In addition, the printing head may have both one color of ink to be used and a plurality of colors of ink.

Furthermore, the example describes a printing head that uses a system for ejecting ink by foaming force generated by applying thermal energy generated by the electro-thermal conversion system to ink, that is, the so-called thermal system. The present invention, however, is not limited to the printing head with a thermal system. For example, a printing head that uses a piezoelectric actuator, such as a piezo element to eject ink is acceptable.

Still furthermore, in the embodiments, liquid that is ejected from the printing head is ink. However, the liquid is not limited to ink in a narrow sense, as described above. For example, liquid can be a processing solvent that is ejected to the printing medium to enhance the fixing property and water resistance of a printed image and to improve image quality of the printed image.

In addition, numerical values shown in the respective embodiments are taken as an example to simplify descriptions, such as the number of nozzles aligned on the printing head, the number of nozzles included in the range of nozzles to be used, a minimum conveying unit determined by basic property of a conveying system including the motors and the transmission mechanism, the conveying amounts selectable on the basis of the relation between the minimum unit and the number of aligned nozzles and so on. Therefore, it is taken for granted that the present invention is not limited to the numerical values.

Moreover, it is taken for granted that the present invention is applicable to the copiers, the facsimile machines having communication systems, printing apparatuses united into a single body in the devices such as word processors, and industrial printing apparatuses (textile printing devices, printers and so on) combined compoundly with various processors, as well as general printing apparatuses that are connected to an image data supply source such as personal computers, digital cameras and scanners to be an information output terminal.

Besides, the present invention is not only applicable to the printing apparatus that uses an ink jet printing head as described above, but also to other printing apparatuses, for example, a printer using the printing head of the thermal transfer type, the wire dot type and like, as long as the printer uses arranged printing elements and performs printing with dots formed by each of the printing elements.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-238864 filed Aug. 18, 2004, which is hereby incorporated by reference herein.

What is claimed is:

1. A printing apparatus that uses a printing head, in which a plurality of printing elements are arranged, to perform printing on a printing medium, said apparatus comprising:

a scanning unit that scans the printing medium with the printing head in a direction different from a direction in which the plurality of printing elements are arranged;

a conveying unit that conveys the printing medium between successive scans by said scanning unit along a conveying path, said conveying unit using a conveying table in which one of a plurality of conveying amounts including at least a conveying amount that is not an integer-multiple of an interval between the printing elements arranged in the arrangement direction is defined for each scan, to refer to the conveying amount corresponding to each scan; and a switching unit that switches the conveying table to be used from among more than one conveying table based on information on a position of the printing medium on the conveying path, wherein said switching unit judges whether the conveying amount, which is not the integer-multiple of the interval and is defined for the scan just before the switching, is the same as the conveying amount, which is not the integer-multiple of the interval and is defined for the scan just after the switching, when executing the switching based on the information, and does not execute the switching when the judgment is affirmative and executes the switching when the judgment is not affirmative.

2. A printing apparatus as claimed in claim 1, wherein said switching unit controls the switching of the conveying table so that said conveying unit conveys the printing medium with the conveying amount defined for the scan which is next refeffed to in the conveying table used before the execution of the switching.

3. A printing apparatus as claimed in claim 1, wherein the plurality of conveying amounts includes at least a first or a second conveying amount that is not the integer-multiple of the interval between the printing elements, and the first conveying amount is expressed by (the interval between the arranged printing elements)×N+(the interval between the arranged printing elements)/M (N: an integer greater than or equal to 0, M: an integer greater than or equal to 2), and the second conveying amount is expressed by (the interval between the arranged printing elements)×N−(the interval between the arranged printing elements)/M (N: an integer greater than or equal to 0, M: an integer greater than or equal to 2).

4. A printing apparatus as claimed in claim 3, wherein the plurality of conveying amounts include a third conveying amount that is an integer-multiple of the interval between the printing elements arranged in the arrangement direction, the third conveying amount is expressed by (the interval between the arranged printing elements)×N (N: an integer greater than or equal to 0).

5. A printing apparatus as claimed in claim 1, wherein said conveying unit conveys the printing medium between successive scans so that a plurality of times of scans are executed at a same printing area of the printing medium with use of different printing elements among the plurality of printing elements for each scan to perform complementary printing, and wherein the conveying table defines the conveying amount for each of the plurality of times of scans for performing complementary printing.

6. A printing apparatus that uses a printing head, in which a plurality of printing elements are arranged, to perform printing on a printing medium, said apparatus comprising:

a scanning unit that scans the printing medium with the printing head in a direction different from a direction in which the plurality of printing elements are arranged;

a conveying unit that conveys the printing medium between successive scans by said scanning means, said conveying means using a conveying table in which one of a plurality of conveying amounts including at least a first or second conveying amount that is not an integer-multiple of an interval between the printing elements arranged in the arrangement direction is defined for each scan, to refer to the conveying amount corresponding to each scan; and a switching unit that switches the conveying table to be used from among more than one conveying table according to a printing area of the printing medium, wherein said switching unit judges whether either one of the first conveying amount or the second conveying amount continues before and after the switching when executing the switching according to the printing area, and does not execute the switching when the judgment is that one of the first conveying amount and the second conveying amount continues and executes the switching when the judgment is that one of the first conveying amount and the second conveying amount does not continue.

7. A printing apparatus as claimed in claim 6, wherein the printing area includes an end area and a normal area other than the end area, and the conveying tables include a first conveying table used for printing the end area and a second conveying table used for printing the normal area, and the switching unit switches between the first conveying table and the second conveying table according to the end area or the normal area.

8. A printing method that scans a printing head, in which a plurality of printing elements are arranged, relatively to a printing medium in a direction different from a direction in which the plurality of printing elements are arranged, to perform printing on the printing medium by means of the printing head, said method comprising the steps of:

conveying the printing medium using a conveying table in which one of a plurality of conveying amounts including at least a conveying amount that is not an integer-multiple of an interval between the printing elements arranged in the arrangement direction is defined for each scan, to refer to the conveying amount corresponding to each scan; and switching the conveying table to be used from among more than one conveying table based on information on a position of the printing medium on a conveying path, wherein said switching step judges whether the conveying amount, which is not the integer-multiple of the interval and is defined for the scan just before the switching, is not the same as the conveying amount, which is not the integer-multiple of the interval and is defined for the scan just after the switching, when executing the switching based on the information, and does not execute the switching when the judgment is affirmative and executes the switching when the judgment is not affirmative.

9. A printing method that scans a printing head, in which a plurality of printing elements are arranged, relatively to a printing medium in a direction different from a direction in which the plurality of printing elements are arranged, to perform printing on the printing medium by means of the printing head, said method comprising the steps of:

conveying the printing medium using a conveying table in which one of a plurality of conveying amounts including at least a first or second conveying amount that is not an integer-multiple of an interval between the printing elements arranged in the arrangement direction is defined for each scan, to refer to the conveying amount corresponding to each scan; and switching the conveying table to be used from among more than one conveying table according to a printing area of the printing medium, wherein said switching step judges whether either one of the first conveying amount or the second conveying amount continues before and after the switching when executing the switching according to the printing area, and does not execute the switching when the judgment is that one of the first conveying amount and the second conveying amount continues and executes the switching when the judgment is that one of the first conveying amount and the second conveying amount does not continue.

* * * * *